US010866060B2

(12) United States Patent
Inneci

(10) Patent No.: US 10,866,060 B2
(45) Date of Patent: Dec. 15, 2020

(54) TELESCOPIC GUNSTOCK COMB ADJUSTMENT MECHANISM

(71) Applicant: Plasmarket Plastik Ve Metal Kalip Makine Sanayi Ticare Limited Sirketi, Konya (TR)

(72) Inventor: Salih Inneci, Konya (TR)

( * ) Notice: Subject to any disclaimer, the term of this patent is extended or adjusted under 35 U.S.C. 154(b) by 0 days.

(21) Appl. No.: 16/467,268

(22) PCT Filed: Feb. 20, 2018

(86) PCT No.: PCT/TR2018/050062
§ 371 (c)(1),
(2) Date: Jun. 6, 2019

(87) PCT Pub. No.: WO2019/040014
PCT Pub. Date: Feb. 28, 2019

(65) Prior Publication Data

US 2019/0301831 A1 Oct. 3, 2019

(30) Foreign Application Priority Data

Feb. 20, 2017 (TR) ..... u 2017 02475

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14
See application file for complete search history.

(56) References Cited

U.S. PATENT DOCUMENTS 5,031,348 A * 7/1991 Carey ..... F41C 23/06 42/71.01
5,392,553 A * 2/1995 Carey ..... F41C 23/14 42/73

(Continued)

FOREIGN PATENT DOCUMENTS

TR 2015/10297 5/2016
WO 2013053504 A1 1/2013

OTHER PUBLICATIONS

International Search Report for PCT/TR2018/050062.
Written Opinion of the ISA for PCT/TR2018/050062.

*Primary Examiner* — J. Woodrow Eldred
(74) *Attorney, Agent, or Firm* — Egbert Law Offices, PLLC

(57) ABSTRACT

A comb adjustment mechanism that adjusts the up and down location of the comb upon the telescopic gunstocks that absorbs recoil with shoulder power caused by shots taken by way of resting the weapon against the shoulder, utilizing combs where the user leans his/her cheek on the comb in order to achieve the optimal aim by taking the user's physical characteristics and shooting position into account. The comb adjustment mechanism has a V-block seat that allows the comb to be secured/placed upon the telescopic gunstock, a spring that provides level lock on beat seats and assists the system in operation by performing centering action in the spring seat placed inside the pushing clamp. The pushing clamp starts and/or stops the up and down movement of the comb and operates by applying force.

9 Claims, 4 Drawing Sheets

(56) References Cited

U.S. PATENT DOCUMENTS

| | | | | |
|---|---|---|---|---|
| 5,933,997 | A * | 8/1999 | Barrett | F41C 23/14<br>42/73 |
| 5,970,642 | A | 10/1999 | Martin | |
| 2007/0289190 | A1* | 12/2007 | Oz | F41C 23/14<br>42/73 |
| 2016/0202016 | A1 | 7/2016 | Mather et al. | |
| 2018/0202756 | A1* | 7/2018 | Shinkle | F41C 23/20 |
| 2018/0335273 | A1* | 11/2018 | Doty | F41C 23/08 |
| 2019/0056192 | A1* | 2/2019 | Frazier | F41C 23/14 |

* cited by examiner

TELESCOPIC GUNSTOCK COMB ADJUSTMENT MECHANISM

TECHNICAL FIELD

The present invention relates to a comb adjustment of length adjustable telescopic gunstocks in rifles and air rifles.

In particular, the invention relates to comb adjustment mechanism that allows user to adjust, mount and dismantle the comb part of the gunstock easily and practically without using any screws and nuts, where the user leans on in order to achieve the optimum aim, taking into account the physical characteristics of the user and shooting position in firearms and pneumatic guns.

STATE OF THE ART

A gunstock is a part of the gun, used in rifles and pistols, which can be in telescopic, stationary or foldable to side or underside forms, made out of plastic, wood or metal and used for reducing the recoil caused by a shot that is taken by resting the weapon against the shoulder. While aiming, the gunstock needs to sit perfectly on the shoulder and to reduce the recoil in an appropriate way. Upon the mainframe of the mentioned gunstocks, a part called comb takes place. This is the part where the user leans his/her cheek on to be able to achieve the perfect aim. These parts are manufactured by taking physical characteristics and shooting position of the user into consideration. The comb part mounted on rifles and pistols allows the adjustment of the surface up and down on which the user's cheek leans on with the purpose of providing convenience while aiming.

In the utility model registration bearing number "2015/10297" that was conducted with the aforementioned technique, the height adjustment was made by way of the comb gauge being secured on the gunstock with screws and nuts. The invention belonging to the present technique comprises metal or hard alloy plastic part (6), placed inside a plastic rail (5) which allows the adjustment of height and fixing of gunstock (1), upon the gunstock (1), the said rail (5) and metal or hard alloy plastic part (6) which allows the contact to the gunstock (1); rod-headed level adjustment pin (4) that is connected to rod-headed pin hole (la) that is formed upon the gunstock (1) and which can be put inside any of the pin holes on the rail (5), bead seats (1*c*) of comb adjustment part formed upon the said gunstock (1), tiered comb adjustment part (2) connected to the gunstock (1) that allows the user to make cheek adjustment, comb adjustment part bead (2*a*) connected to aforesaid comb adjustment part bead seats (1*c*); that constitutes the levels of comb adjustment part (2) and formed upon the aforesaid tiered comb adjustment part (2) (FIG. 5 and FIG. 6).

In the current technique in use, to be able to adjust the comb part the bolt need to be unscrewed and the adjustment of the comb part is made by moving in up and down. Then the bolt needs to be tightened once again in order to secure the comb back to its place.

Comb adjustment system in the present technique described above is not only time consuming but also makes the adjustment process difficult.

Hence, existence of the technical difficulties described above and insufficiency of the existing solutions made an improvement mandatory regarding comb adjustment in telescopic gunstocks.

OBJECTS OF THE INVENTION

The main objective of the invention is to create a comb adjusting mechanism by taking user's physical characteristics and shooting position into account in order to achieve the perfect aim, and a mechanism that will allow the user to adjust, mount or dismantle the comb part of the gunstock easily and practically without using any screws or nuts.

The objective of the invention is to adjust the height of the comb part on the telescopic gunstock in an easier, more practical manner by utilizing a pushing clamp and comb fastener V-shaped block seat.

Another objective of the invention is to achieve a faster way of aiming through the adjustment of comb part quickly by removing the element of nut adjusting from the current technique.

All the advantages and structural and characteristic features of the invention shall be clarified through the figures provided below and with detailed explanations made by referring to these figures. Therefore, the evaluation needs to be made by taking these figures and detailed explanations into account.

REFERENCE NUMBERS

Figure 1:
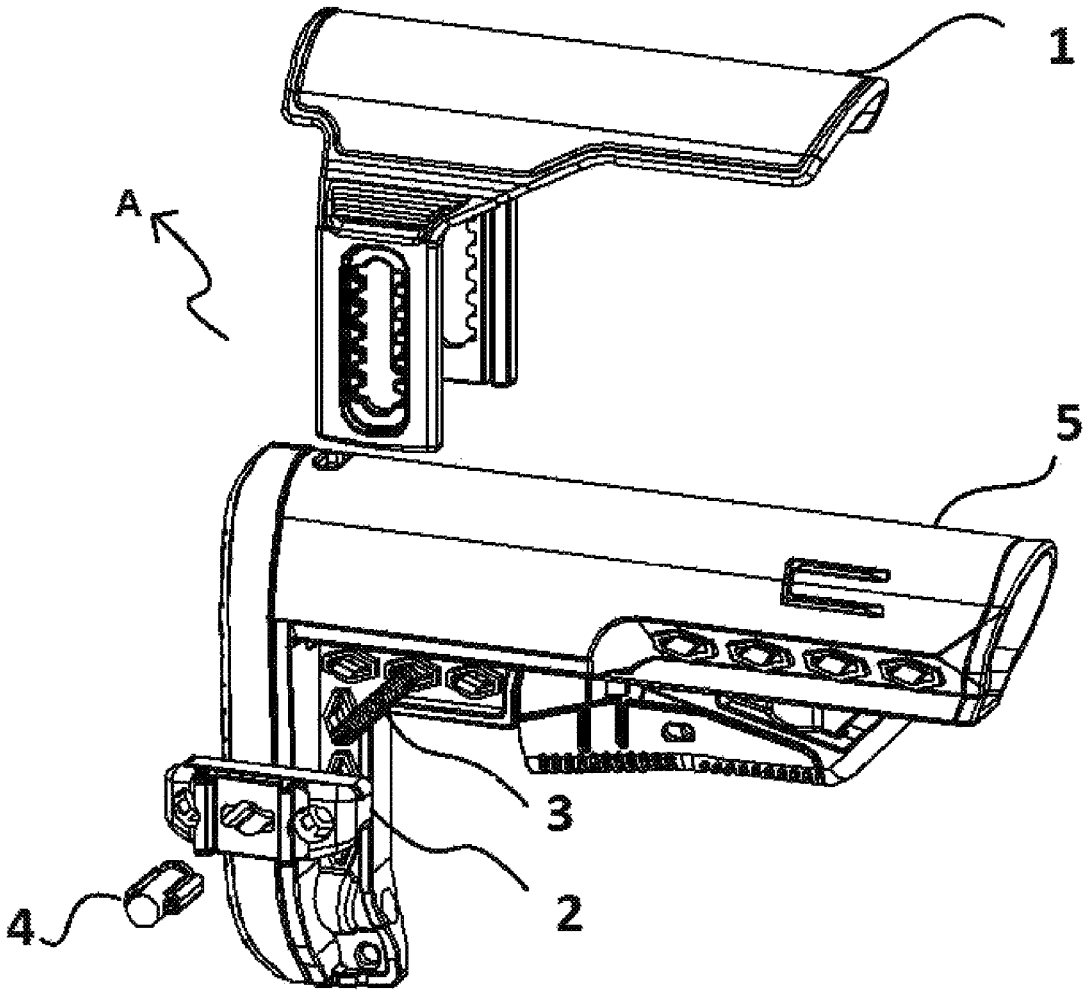
FIG. 1; is the unmounted view of the subject matter telescopic gunstock comb adjustment mechanism.

A. Comb Adjustment Mechanism
1. Comb
1.*a*. Clamp centering seat closed (lowest tier)
1.*b*. Clamp bead seat
1.*c*. Clamp centering seat open (highest tier)
1.*d*. V grooves
1.*e*. Finger rest
2. V block seat
2.*a*. Fixing screw sockets
2.*b*. Pushing clamp seat
2.*c*. V rods.
3. Spring
4. Pushing Clamp
4.*a*. Angled clamp bead
4.*b*. Spring seat
5. Telescopic gunstock Figures do not necessarily have to be scaled. Details that are not necessary to understand the present invention may be omitted. Apart from this, elements that are at least substantially identical or have substantially identical functions are indicated by the same number.

DETAILED DESCRIPTION OF THE INVENTION

In this detailed description, facilitating comb (1) adjustment in telescopic gunstocks (5) and preferred structures for combs (1) that are used in fast aiming in an assistive manner and for comb adjustment mechanism (A) are elaborated only for the better understanding of the subject and not for constituting any restrictive impacts. The working details of this system, which was created in order to improve the existing system, are as follows;

On telescopic gunstocks (5) that assist the user in reducing recoil by using shoulder power, resulting from shots taken by resting the weapon against the shoulder, there is the comb part (1) on which the user leans his/her cheek on in order to achieve the perfect aim by taking physical characteristics and shooting position into account. Location adjustment of the said comb (1) according to user is done by the pushing clamp (4) and V-grooves seat located inside the comb adjustment mechanism (A). The comb (1), while moving up and down through the V-grooves that center the comb inside, it also avoids back-and-forth swinging movement.

Figure 2:
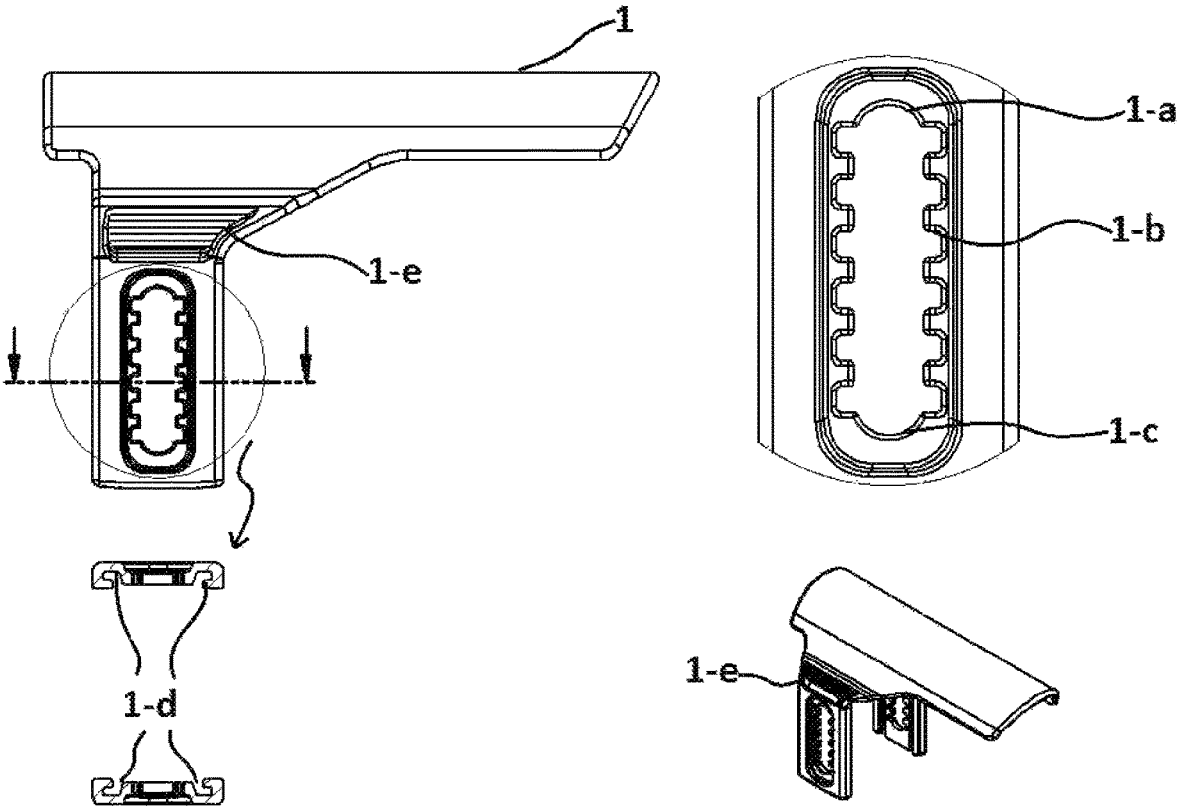
FIG. 2; is the detailed view of the subject matter the comb part inside the telescopic gunstock comb adjustment mechanism from different perspectives.

In the comb adjustment mechanism (A) subject to this invention, comb adjustment is done by clamp centering seats (1-*a*, 1-*c*) that determine the starting and ending (highest and lowest) levels of the comb adjustment. To allow the comb part (1) to be secured in interim levels, a clamp bead seat is installed to the mechanism. By using this clamp bead seat (1-*b*) the user can perform adjusting preferably in five different levels (FIG. 2).

Up and down movement of the comb (1) is done on the V-grooves (1-*d*) which allow the comb to be centered. In addition, another use of these V-grooves (1-*d*) is to facilitate aiming by preventing the back and forth swinging of the comb (1).

Another detail of the comb (1) is the finger rest (1-*e*) that allows the user to adjust the height. The purpose of the said finger rest (1-*e*) is to allow user to lift the comb (1) easier.

Figure 3:
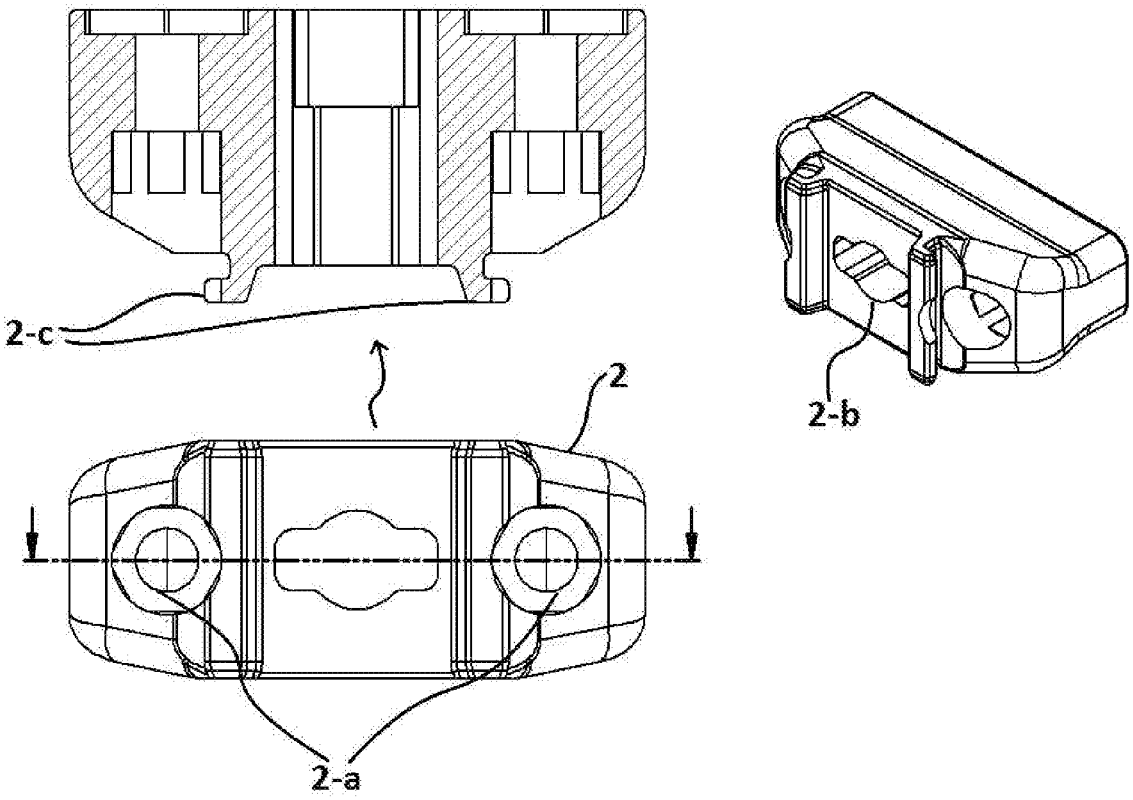
FIG. 3; is the detailed view of the subject matter comb securing V-shaped block seat inside the telescopic gunstock comb adjustment mechanism from different perspectives.

V-block seat (2) that allows the comb (1) to be secured on the telescopic gunstock (5) is fixed preferably using two imbus bolts and nuts. The aforesaid V-block seat (2); provides up and down movement to the comb (1) through V-rods (2-*c*) located on the V-block seat (FIG. 3).

On the V-block seat (2) that allows the comb (1) to be secured, there are fixing screw sockets (2-*a*) for mounting. Two V-block seats (2) are mounted on the telescopic gunstock (5), opposite to the screws and nuts placed in the aforesaid screw sockets (2-*a*). Pushing clamp seat (2-*b*) which is located on the fixing V-block seat (2) is placed for the operation of the pushing clamp (4). The aforesaid pushing clamp seat (2-*b*); acts as a starting and stopping agent for the comb (1) to move up and down by using pushing clamp (4). In short, the pushing clamp (4) is the key for the system.

Figure 4:
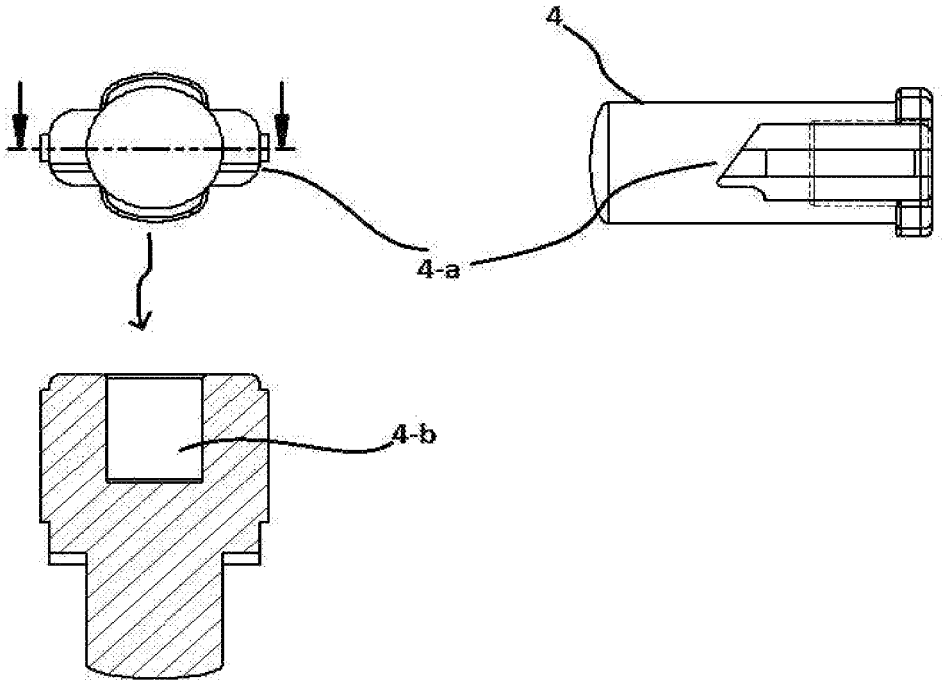
FIG. 4; is the detailed view of the subject matter pushing clamp inside the telescopic gunstock comb adjustment mechanism.
Figure 5:
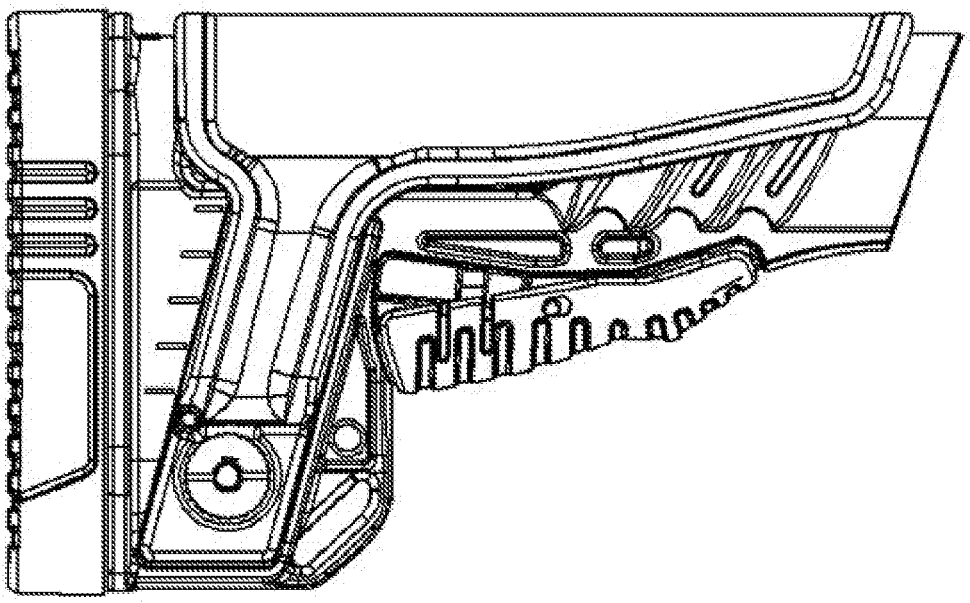
FIG. 5; is the view of the model in which the height adjustment of combs on gunstock is made through screw and nut in the current technique.
Figure 6:
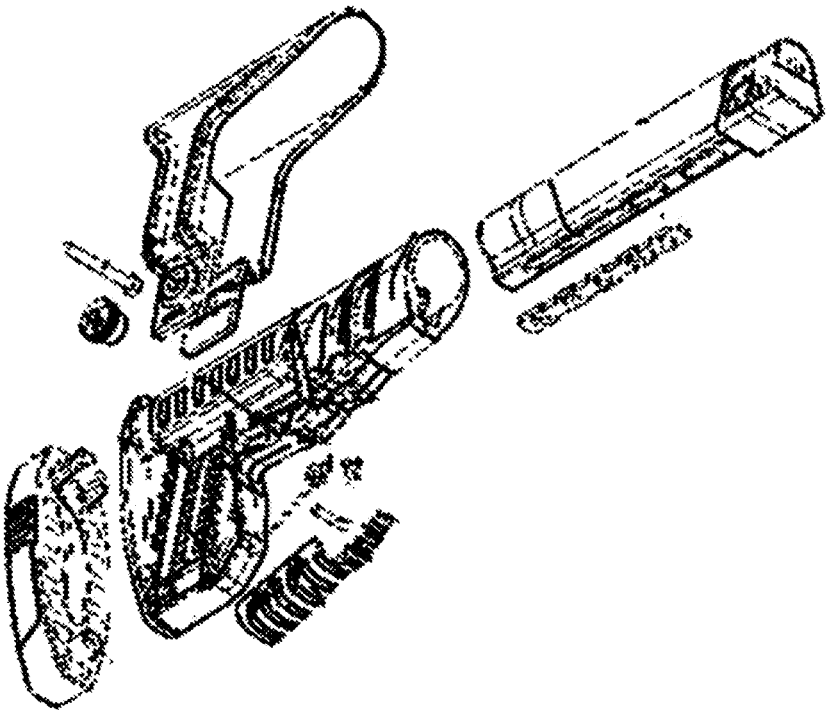
FIG. 6; is another view of the model in which the height adjustment of combs on gunstock is made through screw and nut in the current technique.

FIG. 4 shows different detailed perspectives of the pushing clamp (4) located inside the telescopic gunstock comb adjustment mechanism (A) subject to this invention. The aforesaid angled clamp bead (4-*a*) located on the pushing clamp (4) is an essential part of the system that provides ease. Through the said angled clamp bead (4-*a*) upward movement of the comb (1) is facilitated throughout the system. With the aforesaid angled clamp bead (4-*a*) the comb (1) while moving upward does not require pushing of the clamp (4).

As it is shown in "FIG. 1" and "FIG. 4", there is a spring (3) inside the pushing clamp (4) that assumes an assistive role in the operation of the system and level lock. The aforementioned spring (3) operates inside the spring seat (4*b*) which is located in the pushing clamp (4) by performing centering action.

The invention claimed is:

1. An apparatus comprising:

a telescopic gunstock;

a comb having a surface, said comb adapted to allow a user to rest a cheek on the surface, said comb having a downwardly extending portion with a plurality of bead seats thereon;

a V-block seat affixed to said telescopic gunstock, said V-block seat connected to said comb;

a spring having a spring seat positioned within a pushing clamp, said spring urging against said comb so as to lock said comb to at least one of the bead seats and to center the spring seat inside the pushing clamp, the pushing clamp applying a force onto said comb so as to start or stop a movement of said comb with respect to said telescopic gunstock.

2. The apparatus of claim 1, said comb having a first clamp centering seat formed thereon, the pushing clamp being positioned on the first clamp centering seat.

3. The apparatus of claim 2, said comb having a second clamp centering seat formed thereon.

4. The apparatus of claim 3, said comb having at least one clamp bead seat secured between the first and second clamp centering seats.

5. The apparatus of claim 1, said comb having a pair of grooves formed in the downwardly extending portion, said V-block seat having a pair of portions received respectively in the pair of grooves.

6. The apparatus of claim 1, said comb having a finger rest formed above the downwardly extending portion, the finger rest adapted to allow a use to hold and to lift up said comb.

7. The apparatus of claim 1, further comprising:

at least one fixing screw mounting said telescopic gunstock upon said V-block seat.

8. The apparatus of claim 1, further comprising:

at least one pushing clamp seat cooperative with comb so as to stop the movement of said comb.

9. The apparatus of claim 3, further comprising:

an angled clamp bead cooperative with the pushing clamp when said comb moves between the first and second clamping seats.

* * * * *